US007985055B2

(12) United States Patent
Shin et al.

(10) Patent No.: US 7,985,055 B2
(45) Date of Patent: Jul. 26, 2011

(54) DUAL ROTOR OIL PUMP OF AN ENGINE WITH BALANCE WEIGHT ARRANGEMENT

(75) Inventors: Min Sig Shin, Suwon (KR); Myung Rae Cho, Incheon (KR); Hong Wook Lee, Yongin (KR); Wootae Kim, Suwon (KR); Jin Woo Cho, Seongnam (KR)

(73) Assignee: Hyundai Motor Company, Seoul (KR)

( * ) Notice: Subject to any disclaimer, the term of this patent is extended or adjusted under 35 U.S.C. 154(b) by 688 days.

(21) Appl. No.: 12/018,362

(22) Filed: Jan. 23, 2008

(65) Prior Publication Data

US 2009/0208352 A1 Aug. 20, 2009

(30) Foreign Application Priority Data

Nov. 28, 2007 (KR) ..... 10-2007-0122026

(51) Int. Cl.
*F04B 49/00* (2006.01)
*F04C 2/356* (2006.01)
*F01C 21/00* (2006.01)

(52) U.S. Cl. ..... 417/220; 418/25; 418/151

(58) Field of Classification Search ..... 418/158, 418/151, 106, 265, 26, 30, 24, 25; 417/220; 123/192.2

See application file for complete search history.

(56) References Cited

U.S. PATENT DOCUMENTS

| | | | | |
|---|---|---|---|---|
| 2,555,678 | A * | 6/1951 | Cornwell | 418/151 |
| 3,377,846 | A * | 4/1968 | De Coye De Castelet | 73/66 |
| 5,141,418 | A * | 8/1992 | Ohtaki et al. | 418/26 |
| 6,412,280 | B1 * | 7/2002 | Simonds | 60/643 |
| 6,494,695 | B1 * | 12/2002 | Lifson | 418/55.2 |
| 6,616,433 | B1 * | 9/2003 | Simonds | 418/265 |
| 7,037,088 | B2 * | 5/2006 | Shulver et al. | 417/364 |
| 7,108,493 | B2 * | 9/2006 | Clements et al. | 418/30 |
| 7,306,440 | B2 * | 12/2007 | Amano | 418/151 |

FOREIGN PATENT DOCUMENTS

JP 58096191 A * 6/1983

OTHER PUBLICATIONS

English Abstract of JP58096191A.*
Englsih Abstract of JP58096191A published in Jun. 1983.*

* cited by examiner

*Primary Examiner* — Devon C Kramer
*Assistant Examiner* — Nathan Zollinger
(74) *Attorney, Agent, or Firm* — Morgan, Lewis & Bockius LLP

(57) ABSTRACT

A balance shaft function may be realized without employing a balance shaft, when an oil pump includes an inner rotor fixed to the rotation shaft and an outer rotor that rotates with the inner rotor if at least one rotor of the inner and outer rotors has a mass center formed apart from a rotation center.

6 Claims, 2 Drawing Sheets

DUAL ROTOR OIL PUMP OF AN ENGINE WITH BALANCE WEIGHT ARRANGEMENT

CROSS-REFERENCE TO RELATED APPLICATION

This application claims priority to and the benefit of Korean Patent Application No. 10-2007-0122026 filed in the Korean Intellectual Property Office on Nov. 28, 2007, the entire contents of which are incorporated herein by reference.

BACKGROUND OF THE INVENTION (a) Field of the Invention

The present invention relates to an oil pump of an engine. More particularly, the present invention relates to an oil pump that provides a balancing function for the engine crankshaft.

(b) Description of the Related Art

A crankshaft is precisely designed to balance vibration that may be caused by a reciprocal movement of the pistons. In order to balance vibration, the crankshaft is provided with a balance weight at an opposite side to a crank arm.

Even if vibration of the engine is primarily absorbed by the balance weight of the crankshaft, vibration may not be fully removed thereby. Therefore, in order to balance the remaining vibration of the engine, the engine is typically provided with a flywheel at a side of the crankshaft and a vibration damper of another side thereof. In addition, an engine may be further provided with a balance shaft module that (BSM) that may further balance the remaining vibration.

The balance shaft module typically includes two shafts in parallel. A first shaft of the two balance shafts is usually provided with a sprocket driven by the crankshaft through a gear or a chain. A second shaft of the two shafts is usually externally meshed with the first one by external gears such that the second shaft is driven by the first shaft. Each of the two shafts is provided with a balance weight, i.e., a weight that makes the shaft out of balance, such that the vibration of the engine may be balanced by the rotation of the two shafts.

But with such a complex balance shaft module installed in the engine, the engine becomes bigger in size, and a production cost may increase. Therefore, if balancing of vibration may be accomplished by a simpler scheme, a higher power may be derived from a smaller engine with less vibration, and a production cost may be reduced.

The above information disclosed in this Background section is only for enhancement of understanding of the background of the invention and therefore it may contain information that does not form the prior art that is already known in this country to a person of ordinary skill in the art.

SUMMARY OF THE INVENTION

Embodiment of the present invention provide an oil pump having advantages of providing a crankshaft balance function without a separate balance shaft. An exemplary embodiment of the present invention provides an oil pump mounted on a rotation shaft rotating with a crankshaft of an engine. The oil pump includes: an inner rotor fixed to the rotation shaft; and an outer rotor that rotates with the inner rotor, wherein at least one rotor of the inner and outer rotors has a mass center formed apart from a rotation center.

A rotation center of the outer rotor may be formed apart from a rotation center of the inner rotor; and the outer rotor and the inner rotor may be coupled by a plurality of vanes.

The outer rotor may be provided with a balance weight such that a mass center of the outer rotor may be formed apart from a rotation center of the outer rotor.

The balance weight may be inserted in the outer rotor. The balance weight also may be formed at an interior circumference of the outer rotor.

A mass center of a geometrical shape of the outer rotor may be formed apart from a rotation center of the outer rotor. The inner rotor may be provided with a balance weight such that a mass center of the inner rotor may be formed apart from a rotation center of the inner rotor. The balance weight may be inserted in the inner rotor.

In a further exemplary embodiment, an oil pump may further include: a pivot shaft fixed to the engine; a pump housing that is rotatably engaged to the pivot shaft and receives the inner and outer rotors therein; and a driving device that rotates the pump housing around the pivot shaft.

According to the exemplary oil pump of an exemplary embodiment of the present invention, the balance shaft function may be realized by merely altering the structure of the oil pump, without employing the balance shaft. Therefore, the engine may be light-weighted, and a manufacturing process and production cost may be reduced.

In a further alternative embodiment of the invention, an oil pump engine balancing system comprises a shaft extending from the engine crankshaft and a bearing supporting the shaft. An oil pump is mounted on and driven by the shaft, opposite the crankshaft. The oil pump includes an inner rotor fixed on the shaft and an outer rotor rotating with the inner rotor. At least one of the inner and outer rotors have a mass center formed apart from a rotation center.

In yet another alternative embodiment of the invention, an oil pump engine balancing system comprises a first shaft extending from the engine crankshaft, a first oil pump mounted on and driven by the first shaft, opposite the crankshaft, a second shaft mounted in parallel to the first shaft, a second oil pump mounted on an end of the second shaft; and a driving mechanism cooperatively linking the first and second shafts. At least one bearing supports each of the shafts. The driving mechanism may be, for example, a gear linkage, a chain or belt linkage.

DETAILED DESCRIPTION OF THE EMBODIMENTS

Figure 1:
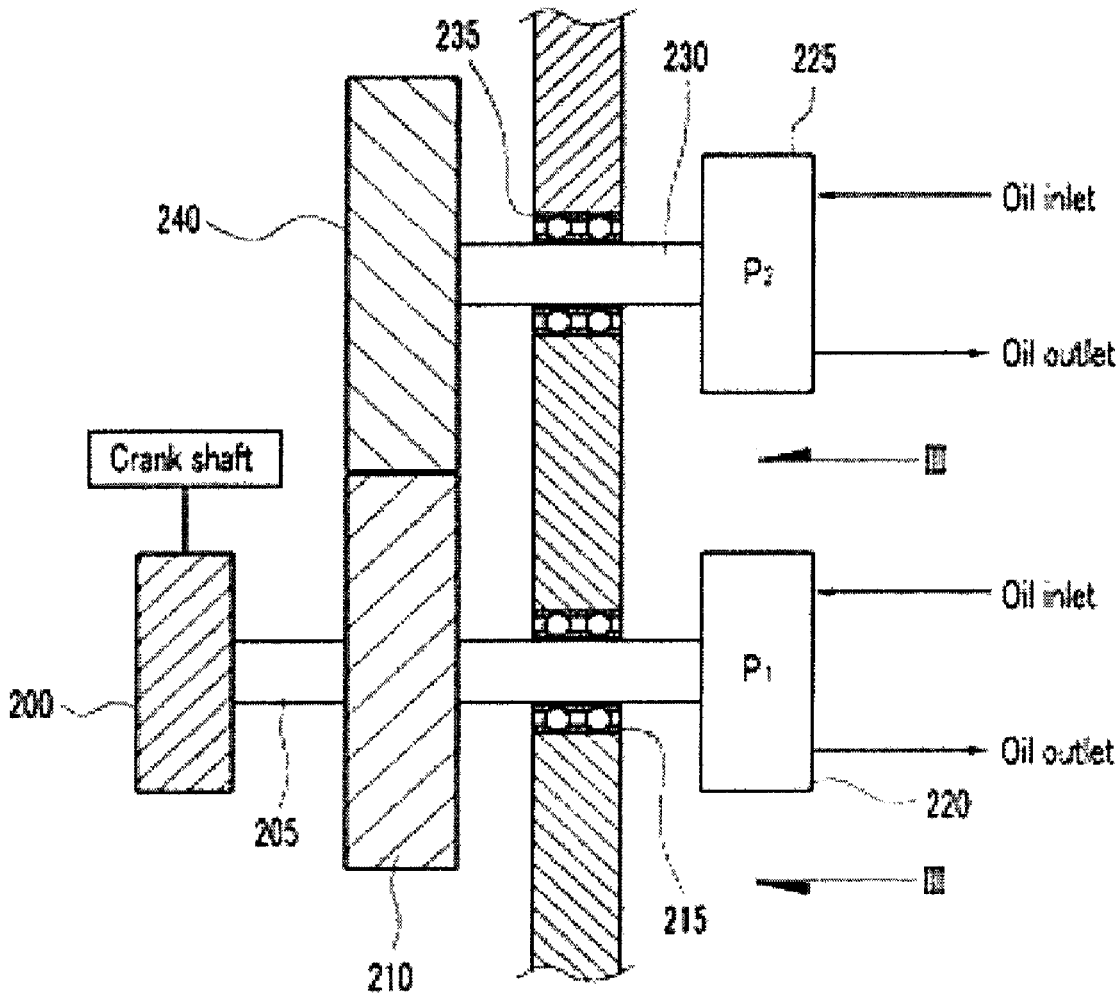
FIG. 1 is a cross-sectional top view of a balance shaft module using oil pumps according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention. In the drawings, the following parts are designated as follows:

200: sprocket
205, 230: shaft
210: first gear
215, 235: first bearing
240: second gear
300: pivot shaft
305: vane groove

310: vane
315: compression space
320: outlet
325: inner rotor
330: outer rotor
335: driving device
340: elastic member
342: protrusion
345: housing
350: inlet space
355, 356, 357: balance weight
360: inlet
365: rotation center of inner rotor
367: mass center of inner rotor
370: rotation center of outer rotor
372: mass center of outer rotor As shown in FIG. 1, a balance shaft module includes a sprocket 200, a first shaft 205, a first gear 210, an oil pump 220 (hereinafter called a first pump) according to an exemplary embodiment of the present invention, a second gear 240, a second shaft 230, and an oil pump 225 (hereinafter called a second pump) according to an exemplary embodiment of the present invention. The first shaft 205 and the second shaft 230 are supported by bearings 215 and 235.

The sprocket 200 is provided at an end of the first shaft 205, and the first pump 220 is provided at another end of the first shaft 205. The first gear 210 is formed at the first shaft 205, for example, at a location between the sprocket 200 and the first pump 220.

The second gear 240 is provided at an end of the second shaft 230, and the second pump 225 is provided at another end of the second shaft 230. The second gear 240 is externally meshed with the first gear 210 such that the second gear 240 may be driven by the first gear 210. The first shaft 205 is driven by a crankshaft (not shown) by a chain or a belt. Therefore, when the engine is running, the first shaft 205 and the second shaft 230 rotate with the crankshaft.

The first pump 220 and the second pump 225 supply oil pressure to moving parts of the engine. According to one exemplary embodiment, balance weights 355, 356, and 357 (refer to FIG. 2) are formed in the first and second pumps 220 and 225, such that the vibration of the engine may be absorbed by an operation of the pumps.

According to one exemplary embodiment, the first pump 220 and the second pump 225 are formed symmetrical to each other. Therefore, in the following description, only the first pump 220 is described in detail with reference to FIG. 2, since the second pump 225 will be apparent from the detailed description of the first pump 220.

Figure 2:
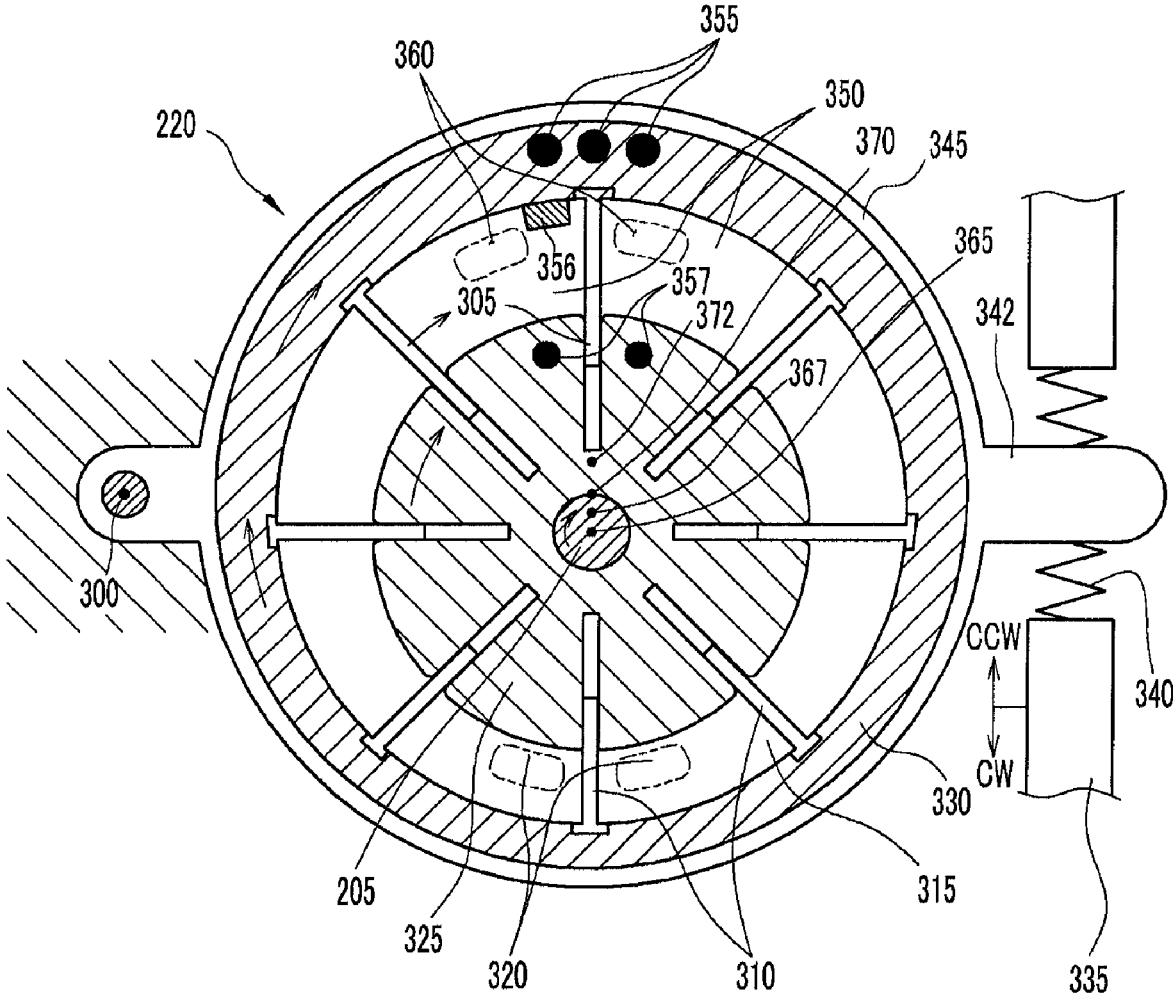
FIG. 2 is a cross-sectional view of an oil pump according to an exemplary embodiment of the present invention.

As shown in FIG. 2, the first pump 220 includes an inner rotor 325, a vane 310, an outer rotor 330, balance weights 355, 356, and 357, a housing 345, a pivot shaft 300, a protrusion 342, an elastic member 340, and a driving device 335.

The inner rotor 325 is mounted on an exterior circumference of the first shaft 205, and the inner rotor 325 rotates with the first shaft 205. That is, the inner rotor 325 is fixed to the first shaft 205.

A plurality of vane grooves 305 are formed at the inner rotor 325. The vane groove 305 is formed from an exterior circumference of the inner rotor 325 toward a center of the first shaft 205. The plurality of vane grooves 305 are formed in equal angular spacing.

The outer rotor 330 encloses the inner rotor 325. A space is formed between an interior circumference the outer rotor 330 and the exterior circumference of the inner rotor 325. A plurality of vanes 310 are formed between the outer rotor 330 and the inner rotor 325. By such a scheme, the outer rotor 330 may rotate with the inner rotor 325.

One end of each vane 310 is fixed to the interior circumference of the outer rotor 330, and another end of the vane 310 is inserted in the vane groove 305 of the inner rotor 325. Thus, as shown in FIG. 2, the first pump 220 (and also the second pump 225) according to one exemplary embodiment has a basic scheme of a vane pump.

The housing 345 encloses the outer rotor 330. The outer rotor 330 rotates by sliding along the interior circumference of the housing 345. The housing 345 is arranged such that it may rotate about the pivot shaft 300. The protrusion 342 is formed at an opposite side of the pivot shaft 300. The protrusion 342 is abutted by the elastic member 340 and the driving device 335. It is to be understood that the elastic member 340 is for absorbing an unnecessary sharp vibration of the first pump 220, and it may be omitted when required. The driving device 335 may be formed in any scheme that may move the protrusion 342 up and down such that the housing 345 may rotate about the pivot shaft 300.

As shown in FIG. 2, the distance between the exterior circumference of the inner rotor 325 and the interior circumference of the outer rotor 330 depends on rotation angle. In more detail, the distance between the exterior circumference of the inner rotor 325 and the interior circumference of the outer rotor 330 is larger at above the inner rotor 325 than at below the inner rotor 325. By such a scheme, the first pump 220 may function as an oil pump.

In FIG. 2, inlets 360 through which the oil flows are formed in an upper region of the first pump 220, and outlets 320 through which the oil flows out are formed in a lower region of the first pump 220. According to one exemplary embodiment, the housing 345 and the outer rotor 330 may rotate clockwise or anticlockwise with a center of the pivot shaft 300 by moving the protrusion 342 by the driving device 335. Pumping capacity of the first pump 220 decreases when the housing 345 rotates clockwise, and the pumping capacity of the first pump 220 increases when the housing 345 rotates anticlockwise.

The balance weights 355 and 356 are formed at the outer rotor 330 such that a mass center 372 of the outer rotor 330 becomes apart from a rotation center 370 of the outer rotor 330. In more detail, the balance weight 355 is inserted in the outer rotor 330, and the balance weight 356 is formed at the interior circumference of the outer rotor 330. For example, the balance weights 355 and 356 may be formed of a material heavier than the outer rotor 330.

The balance weight 357 is formed at the inner rotor 325 such that a mass center 367 of the inner rotor 325 may become apart from a rotation center 365 of the inner rotor 325. For example, the balance weight 357 may be formed of a material heavier than the inner rotor 325.

In addition, the mass center 372 of the outer rotor 330 becomes further apart from the rotation center 370 of the outer rotor 330 because of its geometrical shape. For example, as shown in FIG. 2, the outer rotor 330 is thicker at a region where the balance weight 355 is formed, and is thinner at a region opposite thereto.

By such a scheme, although the inner rotor 325 has its rotation center 365 at the center of the first shaft 205, it has the mass center 367 that is apart upward from the rotation center 365.

In addition, since the outer rotor 330 is eccentrically arranged with respect to the first shaft 205, the rotation center 370 is formed above the center of the first shaft 205. Because of the geometrical shape of the outer rotor 330 and because of the balance weights 355 and 356 in addition thereto, the mass center 372 of the outer rotor 330 is formed above the rotation center 370 of the outer rotor 330.

Therefore, when the first shaft 205 rotates, the biased position of the mass center of the outer rotor 330 generates a vibrating force, and in addition there to, the biased position of the mass center of the inner rotor 325 also generates an additive vibrating force. Such a vibrating force may be used to annul the vibration of the engine that is caused by the rotation of the crankshaft.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An oil pump mounted on a rotation shaft rotating with a crankshaft of an engine, the oil pump comprising:

an inner rotor fixed to the rotation shaft; and an outer rotor that rotates with the inner rotor, wherein at least one rotor of the inner and outer rotors has a mass center formed apart from a rotation center of the corresponding inner and outer rotors;

wherein a rotation center of the outer rotor is formed apart from a rotation center of the inner rotor and the outer rotor and the inner rotor are coupled by a plurality of vanes;

wherein the outer rotor is provided with a balance weight such that a mass center of the outer rotor is formed apart from the rotation center of the outer rotor;

wherein the inner rotor is provided with a balance weight such that a mass center of the inner rotor is formed apart from the rotation center of the inner rotor;

wherein the balance weight of the inner rotor is substantially between the balance weight of the outer rotor and the rotation center of the inner rotor.

2. The oil pump of claim 1, wherein the outer rotor balance weight is inserted in the outer rotor.

3. The oil pump of claim 1, wherein the outer rotor balance weight is formed at an interior circumference of the outer rotor.

4. The oil pump of claim 1, wherein the inner rotor balance weight is inserted in the inner rotor.

5. The oil pump of claim 1, further comprising:

a pivot shaft fixed to the engine;

a pump housing that is rotatably engaged to the pivot shaft and receives the inner and outer rotors; and a driving device that rotates the pump housing around the pivot shaft.

6. An oil pump engine balancing system, comprising:

a shaft extending from an engine crankshaft;

a bearing supporting said shaft;

an oil pump mounted on and driven by said shaft, opposite the crankshaft, said oil pump including an inner rotor fixed on said shaft and an outer rotor rotating with the inner rotor, wherein at least one of the inner and outer rotors have a mass center formed apart from a rotation center of the corresponding inner and outer rotors;

wherein a rotation center of the outer rotor is formed apart from a rotation center of the inner rotor and the outer rotor and the inner rotor are coupled by a plurality of vanes;

wherein the outer rotor is provided with a balance weight such that a mass center of the outer rotor is formed apart from the rotation center of the outer rotor;

wherein the inner rotor is provided with a balance weight such that a mass center of the inner rotor is formed apart from the rotation center of the inner rotor; wherein the balance weight of the inner rotor is substantially between the balance weight of the outer rotor and the rotation center of the inner rotor.

* * * * *